United States Patent [19]

Booth

[11] Patent Number: 5,040,939

[45] Date of Patent: Aug. 20, 1991

[54] WHEELCHAIR LIFT

[75] Inventor: E. Christine Booth, Moran, Kans.

[73] Assignee: Glenda Flowers, Topeka, Kans.

[21] Appl. No.: 571,720

[22] Filed: Aug. 14, 1990

[51] Int. Cl.[5] ..... A61G 7/10

[52] U.S. Cl. ..... 414/678; 254/9 C; 414/921; 414/786; 297/DIG. 4

[58] Field of Search ..... 414/678, 921, 639, 642, 414/778, 781, 786; 254/3 R, 3 B, 3 C, 124; 297/DIG. 4, DIG. 10, 347, 339, 345, 310

[56] References Cited

U.S. PATENT DOCUMENTS

| | | | |
|---|---|---|---|
| 1,275,849 | 8/1918 | Cochran | 254/3 C |
| 1,827,209 | 10/1931 | Robbins | 254/3 C |
| 3,476,404 | 11/1969 | Rachman | 297/DIG. 4 X |
| 4,192,549 | 3/1980 | Petersen | 297/464 |
| 4,389,056 | 6/1983 | Tenniswood | 280/289 |
| 4,527,944 | 7/1985 | Qually et al. | 414/678 |
| 4,592,695 | 6/1986 | McConnell | 414/678 |
| 4,725,188 | 2/1988 | Zimmerman et al. | 414/678 |
| 4,726,730 | 2/1988 | McConnell | 414/678 |
| 4,790,716 | 12/1988 | McConnell | 414/678 |
| 4,834,411 | 5/1989 | Willey et al. | 297/DIG. 4 |
| 4,860,987 | 8/1989 | Werner | 297/345 |
| 4,909,569 | 3/1990 | Gaffney | 297/DIG. 10 |
| 4,941,799 | 7/1990 | Gordon et al. | 414/678 |

*Primary Examiner*—Frank E. Werner
*Assistant Examiner*—Brian Dinicola
*Attorney, Agent, or Firm*—Litman, McMahon & Brown

[57] ABSTRACT

A wheelchair lift for tilting a wheelchair and occupant backwards to a position for having his or her hair dressed or dental work or the like performed includes a pivotable frame onto which the wheelchair is rolled and secured. The lift also includes a fixed frame, a telescoping arm pivotally attached to the fixed frame and to the rear of the pivotable frame, and an electric motor drive which retracts and extends the telescoping arm to pivot the pivotable frame and wheelchair attached thereto about a pivot axis where the pivotable frame and the fixed frame are connected. The pivotable frame includes a horizontal section and an upright section which are connected at the pivot axis. The upright section includes a headrest which is adjustable. In one position the headrest supports the head of the occupant to allow work such as dental work to be performed while in a second position the headrest is retracted beneath the level of the wheelchair to allow free movement of the occupant's head to permit hair-washing and the like.

21 Claims, 2 Drawing Sheets

WHEELCHAIR LIFT

BACKGROUND OF THE INVENTION

The present invention relates to a lifting apparatus for tilting a wheelchair and occupant to facilitate services to the wheelchair occupant including hair-washing, dental work, periodically adjusting the occupant to a more relaxed, reclining position, etc.

The number of persons occupying wheelchairs, whether on a temporary or permanent basis, numbers in the hundreds of thousands. Even though they are not ambulatory, these persons still need services which the remainder of the public take for granted, such as dental work, hair care, etc. Furthermore, wheelchair occupants have to remain in an upright, sitting position for extended periods of time. This results in increased muscular tension and reduced circulatory function.

It has been common practice in the past for a wheelchair occupant to be bodily lifted from the wheelchair and placed in a hydraulically operated dental, hairdresser's, or other reclining chair. Due to the awkwardness of such a move, the fact that the wheelchair occupant is often incapable of assisting, and the fact that many people in wheelchairs are further restrained by colostomy bags, urine bags or other attachments to their body and/or wheelchair, it generally takes two or three people to move an occupant in this way.

In a nursing home, personnel doing such moving are typically required to be certified and licensed and, consequently, the provision of sufficient personnel for such frequent moves is both labor-intensive and extremely expensive. In other environments, such as beauty or barber shops and dentists' offices, no trained personnel at all are available for such situations. As an additional complication, many persons in wheelchairs are simply not in good enough physical condition to permit frequent moves of this type.

As a consequence, the need exists within the industry for a simple, inexpensive, lifting apparatus which permits an occupied wheelchair to be pivoted to a desired tilted position during procedures such as hair-dressing and dental work or when the need exists for simply placing the occupant in a more relaxed, reclining position.

It is also important to provide such an apparatus which can be operated by personnel untrained in moving patients, such as dentists or hairdressers.

It is also important to provide secure support for both the wheelchair and the occupant's head when the wheelchair is pivoted.

Finally, it is desirable to provide an apparatus for tilting a wheelchair that can rest directly on the floor of the room where the person with wheelchair is to be tilted without requiring special ramps that would make the patient too high or require placing part of the apparatus beneath the floor level. Furthermore, the apparatus is preferably relatively portable so that it can be moved into position for use when needed and removed when not in use.

OBJECTS OF THE INVENTION

Therefore, the objects of the present invention are: to provide a relatively simple, stable and effective wheelchair lift which permits a wheelchair occupant to remain in the chair while the chair is pivoted to a desired tilted position for services such as hair-dressing or dental work; to provide such an apparatus which is operable by relatively untrained personnel, such as hairdressers or dentists; to provide such an apparatus which is relatively inexpensive to manufacture and maintain; to provide an adjustable belt on the apparatus for securing the wheelchair to the apparatus; to provide an adjustable headrest mounted on the apparatus, which, in one position, supports the occupant's head when the wheelchair is pivoted to a desired tilted position and, in a second position, is swung out of the way so that the occupant's head is free from constraint to facilitate, for example, hair-washing and the like; to provide such a apparatus having adjustable tilt positions for a wheelchair by using a telescoping rod which is turned via a reversible electric motor; to provide such an apparatus that is relatively portable and does not require special installation or ramps; to provide such an apparatus that, when in a tilted position, places the head of the wheelchair user in normal position for personnel to work on or about the wheelchair user's head; to provide a method of pivoting a wheelchair-bound person to a desired tilted position which does not necessitate removing the person from the wheelchair; and to provide such an apparatus that is relatively easy to use and operate, and especially adapted for the intended usage thereof.

Other objects and advantages of this invention will become apparent from the following description, taken in conjunction with the accompanying drawings wherein ar set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

Figure 2:
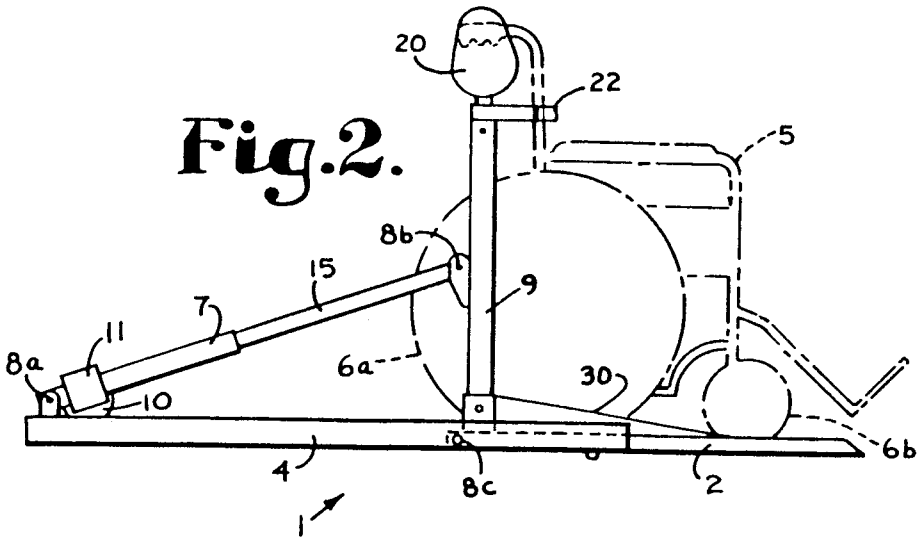
FIG. 2 is an enlarged, side elevational view of a wheelchair lifting apparatus in a horizontal, untilted or flat position with a wheelchair shown in phantom relief mounted thereon.

As required, detailed embodiments of the present invention are disclosed herein; however, it is to be understood that the enclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriate structure.

The reference numeral 1 generally designates a wheelchair lift for tilting a wheelchair and occupant to the rear for facilitating services such as hair-dressing, dental work, etc.

Figure 1:
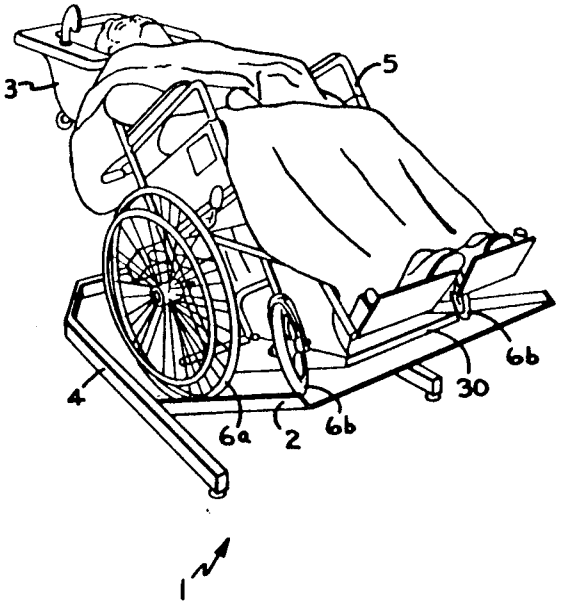
FIG. 1 is a perspective view of a wheelchair lifting apparatus in accordance with the present invention, shown with a wheelchair and occupant positioned thereon and pivoted to a tilted position, with the occupant's head placed in a washbasin.

FIG. 1 shows the wheelchair lift 1 with a wheelchair 5 positioned on and secured to a pivotable support frame 2 with the support frame 2, wheelchair 5, and occupant tilted to the rear in a washbasin 3. The wheelchair lift 1 is designed to be used with any conventional wheelchair 5 including motorized versions. Conventional wheelchairs are generally provided with a set of two, relatively large rear wheels 6*a* which roll easily, and another set of two, much smaller front wheels 6*b* which are usually free castering to provide steering. Between the two sets of wheels 6*a* and 6*b* is a collapsible webbing or fabric suspended on a frame upon which the occupant sits and rests his or her back. Such a wheelchair is shown in FIG. 1. FIG. 1 also illustrates one of many uses for the wheelchair lift. Here, the occupant's head is shown resting in the washbasin 3 preparatory to having his or her hair washed.

Figure 3:
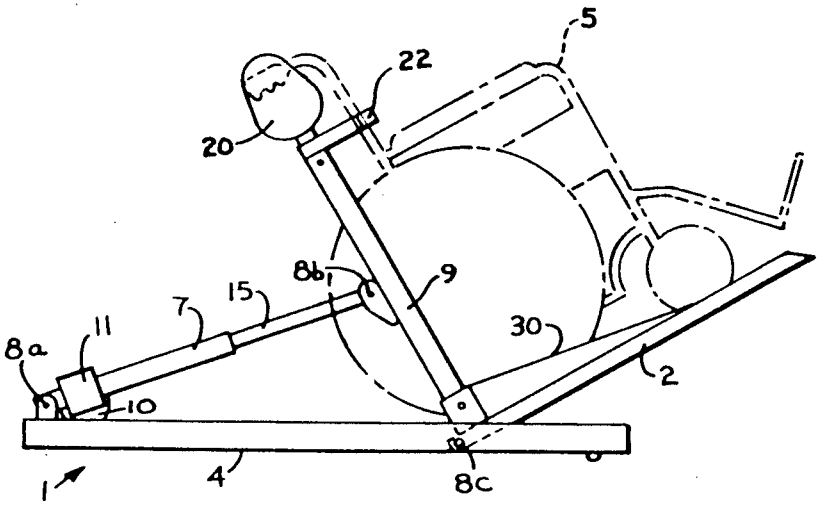
FIG. 3 is another enlarged, side elevational view of the wheelchair lifting apparatus, shown in a tilted position, again, with the wheelchair shown in phantom relief mounted thereon.

The operational mechanism of the wheelchair lift 1 is better illustrated in FIGS. 2 and 3, which show a horizontal and a tilted position for the lift, with the wheelchair 5, shown in phantom relief, mounted thereon. In FIG. 2, a telescoping arm 7 is shown with one end attached to a pivot point 8*a* on the rear of a fixed U-shaped frame 4. The other end of telescoping arm 7 is attached to an upright member 9 of the pivotable support frame 2 at pivot point 8*b*.

The upright member 9, when the apparatus 1 is in the tilted position thereof, also supports the wheelchair 5 via its backrest. FIG. 2 shows the telescoping arm 7 in an extended position that effectively places the pivotable wheelchair support frame 2 and wheelchair 5 flat on the floor. In this position, the pivotal support frame 2, which is generally planar and relatively flat, lies on the floor so as to allow easy access of the wheelchair 5 onto and off the frame 2.

Figure 4:
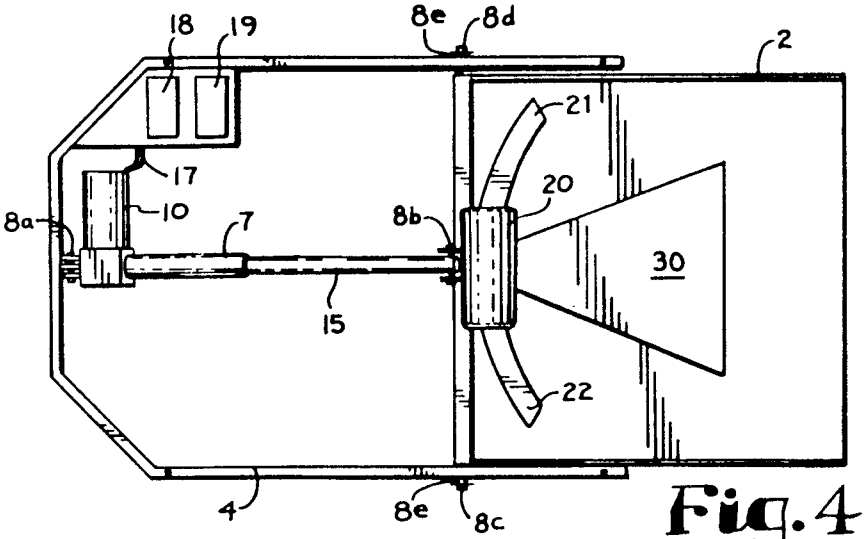
FIG. 4 is an enlarged, top plan view of the wheelchair lifting apparatus shown with a telescoping arm thereof in an extended position and showing foot-controlled switches for controlling the extension of the arm.

FIG. 3 shows telescoping ar 7 retracted (the retraction pivoting the chair support frame 2 and wheelchair 5 about pivot axis 8*c*) and placing the wheelchair 5 and the occupant in a rearward tilted position. Pivot axis 8*c*, as shown in FIG. 4, is associated with an axle 8*d* extending through a sleeve on pivotable frame 2 at the point where the horizontal frame section 4 and an upright frame section 9 meet. The axle 8*d* also extends through a n aperture in each leg of the U-shaped fixed frame 4. Spring-loaded rings 8*e* are placed over the ends of axle 8*d* to lock the latter in position. The telescoping arm 7 is selectively operated by a reversible electric motor 10 driving a worm gear system 11, better illustrated in FIG. 7.

Figure 7:
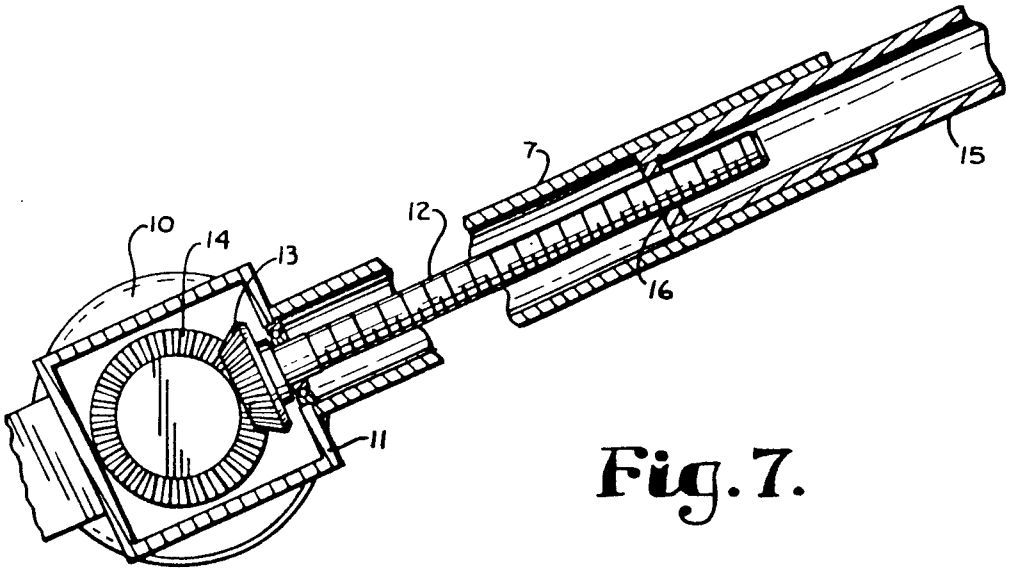
FIG. 7 is an enlarged, fragmentary view of a telescoping arm for controlling the degree of tilt of the wheelchair lifting apparatus, with portions broken away to show detail thereof.

As shown in FIG. 7, an extendable portion 15 of the telescoping arm 7 is attached to a threaded rod 12 at location 16. A threaded rod 12 is, in turn, attached to a worm gear 13. The worm gear 13 is driven by a matching gear 14 which is driven by a reversible motor 10. When the motor 10, and thus the gear 14, are rotated in a clockwise direction as shown, the extendable arm 15 is retracted. Conversely, operation of the motor 10 and the gear 14 in a counterclockwise direction extends the extendable arm 15. As described earlier, when the extendable arm 15 is retracted, the wheelchair support frame 2, wheelchair 5 and occupant are pivoted to a desired tilted position which results in the occupant being placed in a rearward reclining position. Extension of the arm 15 acts to place the support frame 2, wheelchair 5 and occupant in a horizontal position. Stopping the motor at any desired position allows the degree of tilt to be controlled as desired.

FIG. 4 is a top plan view of the wheelchair lift 1 showing the telescoping arm 7 in an extended position. The reversible electric motor 10 is shown connected via cable 17 to foot-operated, on/off switches 18 and 19. One of the switches 18 or 19 is operated to extend the telescoping rod 12 and the other to retract it. It is foreseen that the switches 18 and 19 could be remotely mounted on a longer cable which could be made to be accessible to the occupant of the wheelchair 5. FIG. 4 also illustrates a top view of an adjustable headrest 20 and extending arms 21 and 22 for engaging the backrest of the wheelchair. Also shown in FIG. 4 is a pivotable support frame 2, with a triangular-shaped, reinforcing box 30 in the middle thereof to strengthen the 17 apparatus 1. The box 30, also shown in FIGS. 1–3, forms a raised area over which the center of the wheelchair 5 is placed. Besides providing added strength, the box 30 acts as a guide when rolling a wheelchair 5 onto the pivotable frame 2.

Figure 5:
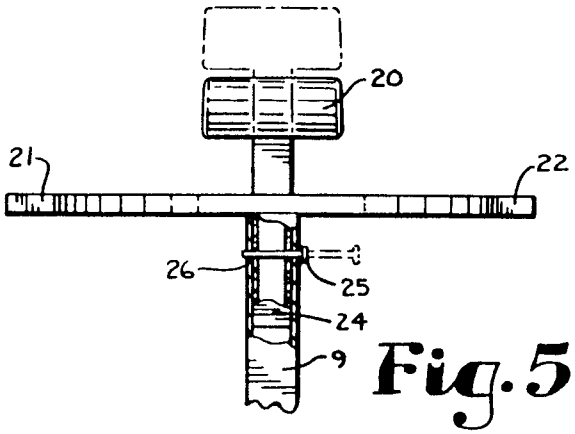
FIG. 5 is an enlarged, frontal view of an upright portion of a pivotable frame for the wheelchair lifting apparatus, including an adjustable headrest, with the headrest shown in solid lines in the retracted position and in phantom lines in the extended position.

FIG. 5 is a frontal view of the adjustable headrest 20 and the extending arms 21 and 22. The headrest 20 is depicted in solid lines in its retracted position and in phantom lines in its extended position. As illustrated, the headrest 20 is adjusted by retracting a pin 25, raising or lowering the headrest 20 to the desired position, and reinserting the pin 25 into one of several through bores 26 in a sliding section 24.

Figure 6:
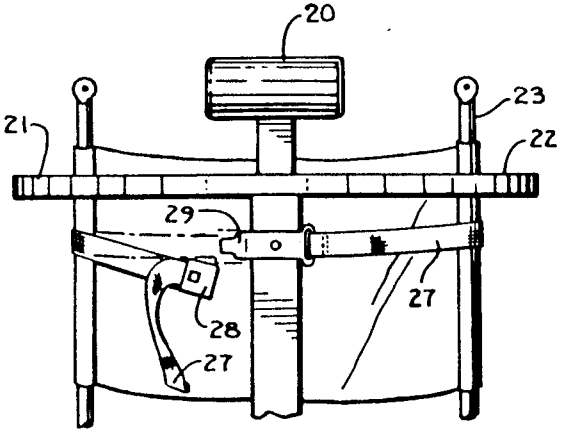
FIG. 6 is an enlarged, rear view of the upright portion of the pivotable frame of the wheelchair lifting apparatus including a portion of a backrest of a wheelchair shown mounted thereon and strapped thereto by an adjustable belt.

FIG. 6 is a rear view showing an upright frame 9 of the pivotable support frame 4 secured to extending arms 21 and 22 and headrest 20. A wheelchair 5 is shown attached thereto via the backrest 23. As illustrated, the wheelchair 5 can be securely fastened to the upright member 9 via an adjustable belt 27 which is similar in operation to an ordinary automobile seatbelt. A belt clasp 28 can be hooked onto a fastener 29 and tension on the belt 27 can be adjusted simply by pulling on the loose end of the belt 27.

Both the horizontal frame 2 and vertical frame 9 (the terms horizontal and vertical referring to when in the untilted position) are constructed such that, when the pivotal support frame 2 is tilted, the pivot axis thereof is approximately under the center of gravity of the combined support frame 2 and 9 holding a wheelchair 5 occupied by an ordinary-sized individual. This insures that the forces necessary to pivot the pivotal support frame 2 and retain it in a tilted position are kept to a minimum. Furthermore, the placement of the fixed U-shaped frame 4 flat on the floor with the pivot axis located between the arms of the "U" provides maximum stability and resistance to tipping.

In operation, an occupied wheelchair 5 is simply rolled backwards onto the pivotable frame 2, which can be accomplished by the occupant alone or by a single, assisting individual. The wheelchair 5 is then secured to the vertical portion 9 of the pivotable frame 2 via the belt 27. The pivotable frame 2, the wheelchair 5 and occupant are then pivoted to a desired tilted position by utilizing the foot switches 18 and 19, as described earlier.

While the wheelchair lift 1, as illustrated herein, incorporates a telescoping arm controlled by a worm gear, it should be apparent that any desired drive mechanism could be used. This could include, for example, a chain-and-sprocket drive, a hydraulic telescoping rod, or a belt-driven system. Furthermore, while the illustrated embodiment uses an electric motor drive, a manually-driven mechanism could be employed as well.

While the wheelchair lift I has been described as usable in dental or hair-dressing operations, it should be obvious that it could be used in any operation requiring a wheelchair occupant to be placed in a tilted position. Examples would include podiatrists or other medical personnel performing certain types of medical exams or physical therapy. As earlier mentioned, an important use for the disclosed apparatus 1 is to place the wheelchair occupant in a more comfortable position for muscle or circulatory stimulation or simply for relaxing or sleeping.

It is to be understood, that while certain forms of the present invention have been illustrated and described herein, it is not to be limited to the forms or arrangements of parts described and shown.

What is claimed and desired to be secured by letters patent is as follows:

1. An apparatus for pivoting a wheelchair and occupant thereof to a desired tilted position comprising:

(a) a pivotable frame for holding said wheelchair and occupant; said pivotable frame comprising a horizontal section and an upright section when in an untilted position thereof; said horizontal section being relatively flat and adapted to be positioned directly adjacent a floor supporting the apparatus when in the untilted position such that a ramp is not required for rolling said wheelchair thereon; said sections being attached to each other at a fixed pivot axis located near a rearward end of said pivotable frame horizontal section; said pivotable frame horizontal section when in the untilted position being low profile so as to provide unhindered access to the sides of the wheelchair and to the upper body of the occupant; said pivotable frame horizontal section having a reinforcing box centrally located on an upper side of said pivotable frame horizontal section for guiding said wheelchair when rolling said wheelchair onto said pivotable frame horizontal section;

(b) a drive mechanism adapted to selectively pivot said pivotable frame including the wheelchair and occupant held thereon to a desired tilted position;

(c) a fixed frame attached to said pivotable frame at said fixed pivot axis; said pivot axis being located on said fixed frame near a lower edge of said fixed frame so as to be adapted to be closely spaced relative to a floor supporting said fixed frame;

(d) said fixed frame being U-shaped with a pair of arms and resting longitudinally on the floor, said fixed pivot axis extending between the arms of said fixed frame; each of said arms having a forward portion and a rearward portion located respectively forward and rearward of said fixed pivot axis and further adapted to engage a floor supporting said fixed frame so as to prevent tipping of said apparatus forward or rearward during use; said fixed frame having a low profile so as to be adapted to be located entirely near a floor supporting said fixed frame to allow unhindered access to sides of the wheelchair supported on said pivotable frame during usage; and (e) said drive mechanism having two ends and being attached at one end to said fixed frame and at the other end to said pivotable frame.

2. The apparatus according to claim I, wherein:

(a) said drive mechanism is a telescoping rod means.

3. The apparatus according to claim 2, wherein:

(a) said telescoping rod means includes a worm gear and a retractable arm connected to said worm gear via a threaded rod.

4. The apparatus according to claim 3, wherein:

(a) said worm gear is driven by a reversible motor, said reversible motor being selectively driven in one direction by operation of one on/off switch, and selectively driven in the other direction by a second on/of switch.

5. The apparatus according to claim 4, wherein:

(a) said switches are foot-controlled.

6. The apparatus according to claim 1, wherein:

(a) a headrest means is attached to said upright frame section.

7. The apparatus according to claim 6, wherein:

(a) said headrest means is vertically adjustable to accommodate different wheelchair occupants and can be retracted to allow free movement of an occupant's head.

8. The apparatus according to claim 1, wherein:

(a) attachment means are mounted on said upright frame section to securely attach a wheelchair thereto.

9. The apparatus according to claim 8, wherein:

(a) said attachment means comprise an adjustable belt with a clasp which can be opened and closed.

10. The apparatus according to claim 8, wherein:

(a) said upright frame section includes two horizontally-extending arms adapted to receive a backrest portion of a wheelchair mounted thereto.

11. An apparatus for pivoting a wheelchair and occupant thereof to any desired tilted position comprising:

(a) a pivotable frame for holding said wheelchair, said pivotable frame comprising a horizontal section and an upright section when in an untilted position thereof; said sections being attached to each other at a fixed pivot axis located near a rearward end of said pivotable frame horizontal section; said pivotable frame having a low profile for providing unhindered access to the sides of the wheelchair and to the upper body of the occupant; said pivotable frame having a reinforcing box centrally located on an upper side of said pivotable frame horizontal section for guiding said wheelchair when said wheelchair is rolled onto said pivotable frame;

(b) a fixed frame to which said pivotable frame is attached at said fixed pivot axis; said fixed pivot axis being located on said fixed frame near a lower edge of said fixed frame so as to be adapted to be closely spaced relative to a floor supporting said fixed frame; said fixed frame having a low profile so as to be adapted to be located entirely near a floor supporting said fixed frame to allow unhindered access to sides of the wheelchair supported on said pivotable frame during usage;

(c) a drive mechanism including a telescoping rod attached at one end to said upright section of said pivotable frame and at the other end to said fixed frame and adapted, when retracted, to selectively pivot said frame including the wheelchair and occupant held thereon to a desired tilted position; and (d) said telescoping rod means including a worm gear and a retractable arm; said retractable arm being connected at one end to said worm gear via a threaded rod and at the other end to said upright section of said pivotable frame.

12. The apparatus according to claim 11, wherein:

(a) said worm gear is driven by a reversible motor; said reversible motor being selectively driven in one direction by operation of one on/off switch, and selectively driven in the other direction by another on/off switch.

13. The apparatus according to claim 12, wherein:

(a) said switches are adapted to be foot-controlled.

14. The apparatus according to claim 11, wherein:

(a) headrest means are attached to said upright frame section.

15. The apparatus according to claim 14, wherein:

(a) said headrest means are vertically adjustable to accommodate different wheelchair occupants and can be retracted to allow free movement of an occupant's head.

16. The apparatus according to claim 11, wherein:

(a) adjustable attachment means are mounted on said upright frame section to securely attach a wheelchair thereto.

17. The apparatus according to claim 16, wherein:

(a) said attachment means comprise an adjustable belt with a clasp which can be opened and closed.

18. The apparatus according to claim 11, wherein:

(a) said upright frame section includes two generally horizontally-extending arms adapted to receive a backrest portion of a wheelchair mounted thereto.

19. The apparatus according to claim 11, wherein:

(a) said horizontal section is generally planar and is adapted to flatly, directly abut a floor supporting said apparatus to allow a wheelchair to be easily rolled thereon without the use of a ramp.

20. A method of pivoting a wheelchair and occupant thereof from an upright position to selected tilted positions, comprising the steps of:

(a) rolling the wheelchair and occupant, without a ramp, onto a planar and relatively flat, pivotable support frame pivotably secured to a fixed frame wherein said pivotable support frame and said fixed frame being low profile so as to provide unhindered access to the sides of the wheelchair and to the upper body of the occupant and wherein said pivotable support frame has a reinforcing box centrally located on an upper side of said pivotable support frame which acts as a guide when rolling said wheelchair onto said pivotable frame and wherein said pivotable frame and said fixed frame are in abutting contact with a surrounding floor when in an untilted position and securing said wheelchair to said pivotable support frame;

(b) selectively pivoting said support frame, with said wheelchair and occupant secured thereto, to said desired tilted position; and (c) said selectively-pivoting step including retracting a telescoping rod which has one end attached to said pivotable support frame and the other end attached to a fixed frame to which said pivotable frame is also attached at a pivot axis.

21. The method according to claim 20 further comprising the step of:

(a) resting the wheelchair occupant's head against an adjustable headrest to provide support therefor while said wheelchair is being tilted.

* * * * *